United States Patent [19]

Meissgeier

[11] Patent Number: 5,030,061

[45] Date of Patent: Jul. 9, 1991

[54] CASING FOR INLINE CENTRIFUGAL PUMPS

[75] Inventor: Achim Meissgeier, Frankenthal, Fed. Rep. of Germany

[73] Assignee: KSB Aktiengesellschaft, Frankenthal/Pfalz, Fed. Rep. of Germany

[21] Appl. No.: 532,347

[22] Filed: May 31, 1990

Related U.S. Application Data

[63] Continuation of Ser. No. 358,422, May 26, 1989, abandoned.

[30] Foreign Application Priority Data

Jun. 1, 1988 [DE] Fed. Rep. of Germany ..... 3818651

[51] Int. Cl.[5] ..... F04D 29/00; F04D 11/00

[52] U.S. Cl. ..... 415/203; 415/214.1

[58] Field of Search ..... 415/182.1, 183, 203, 415/209, 205, 219.1, 215.1, 175

[56] References Cited

U.S. PATENT DOCUMENTS

| | | | |
|---|---|---|---|
| 898,493 | 9/1908 | Montgomery | 415/175 |
| 2,997,958 | 8/1961 | Heinicke | 415/214.1 |
| 3,037,458 | 6/1962 | Olmstead et al. | 415/214.1 |
| 3,059,582 | 10/1962 | Greene et al. | 415/175 |
| 3,269,703 | 8/1966 | Durdin et al. | 415/214.1 |
| 4,172,697 | 10/1979 | Schoen | 415/175 |
| 4,448,573 | 5/1984 | Franz | 415/182.1 |
| 4,530,640 | 7/1985 | Macinnes | 415/205 |
| 4,549,849 | 10/1985 | Jensen et al. | 415/182.1 |
| 4,565,068 | 1/1986 | Schneider | 415/205 |

FOREIGN PATENT DOCUMENTS

| | | | |
|---|---|---|---|
| 640951 | 5/1962 | Canada | 415/205 |
| 2707776 | 2/1977 | Fed. Rep. of Germany . | |
| 3210526 | 3/1982 | Fed. Rep. of Germany . | |
| 3622269 | 1/1988 | Fed. Rep. of Germany | 415/182 |
| 1237961 | 7/1971 | United Kingdom | 415/182 |

*Primary Examiner*—Edward K. Look
*Assistant Examiner*—Hoang Nguyen
*Attorney, Agent, or Firm*—Peter K. Kontler

[57] ABSTRACT

A casing for use in an in-line centrifugal pump has two mirror symmetrical shell-shaped sections which jointly define a suction inlet at one end and an outlet at the other end of the casing. A partition is located in the symmetry plane of the two sections to define a suction chamber with one of the sections and a pressure chamber with the other section. The partition has a first shroud which extends into the inlet and is disposed at one side of the symmetry plane, and a second shroud which extends into the outlet and is disposed at the other side of the symmetry plane. The symmetry plane is normal to the axis of the pump shaft, and the other section has an aperture for a portion of the housing of a pump stage or for an impeller. Such aperture is in register with a centrally located opening which is provided in the partition and extends between the two chambers, The marginal portions of the partition are soldered, welded or glued to outwardly extending flanges of the sections. The partition reinforces the entire casing and provides a path for transmission of forces from a pipe which is connected with the inlet to a pipe which is connected with the outlet.

13 Claims, 1 Drawing Sheet

CASING FOR INLINE CENTRIFUGAL PUMPS

This application is a continuation of application Ser. No. 358,422, filed May 26, 1989 now abandoned.

BACKGROUND OF THE INVENTION

The invention relates to pumps in general, and more particularly to improvements in casings for centrifugal pumps. Still more particularly, the invention relates to improvements in casings for single-stage or multi-stage in-line centrifugal pumps.

German Pat. No. 32 10 526 to Jensen et al. discloses a single-stage in-line pump with a casing which is assembled of two sections. The sections are joined to each other in a plane which includes the axis of the pump shaft. The casing resembles a volute and its sections are not identical, i.e., they are not mirror images of each other. This contributes to the initial cost of the casing because each of the two sections must be shaped in a different tool. The cost of such pumps is especially high if the pumps are to be furnished in different sizes so that a set of two different tools is needed for the making of each of two or more sets of casings having different sizes. The patented pump further comprises a partition which is installed between the two sections of the casing in such position that its plane is disposed at right angles to the plane in which the two sections are secured to each other. This necessitates the establishment of first connections between the partition and the two sections of the casing, and the establishment of additional connections between the sections. As a rule, the sections are secured to each other in a first step, and the partition is thereupon installed between the assembled sections in a next-following step.

U.S. Pat. No. 3,059,582 to Greene et al. discloses a motor pump unit with a pump casing which is assembled of two sections and further comprises a partition which is installed between the two sections in a separate step following attachment of the sections to each other. This contributes to the cost of the casing.

German Pat. No. 27 07 776 to Le Dall discloses a multi-stage centrifugal pump with an intermediate housing or casing which is made in an injection molding or casting machine and embodies an integral partition. The intermediate casing is further provided with a flange for attachment to the housing of a motor. That side of the casing which is located opposite the flange can be connected to the housing of a first pump stage. The partition of the casing separates a pressure chamber from a suction chamber and is provided with a hole for sealing means surrounding the pump shaft. The casing of Le Dall is complex and expensive. Moreover, such casing must have thick walls if it is to stand the forces which are transmitted when the pump is installed in line with a first pipe which supplies fluid to the inlet and with a second pipe which receives pressurized fluid from the outlet of the casing.

OBJECTS OF THE INVENTION

An object of the invention is to provide a novel and improved in-line pump.

Another object of the invention is to provide a novel and improved casing for use in an in-line centrifugal pump.

A further object of the invention is to provide a simple and inexpensive casing which is lighter than but sturdier than heretofore known casings.

An additional object of the invention is to provide a casing which can be assembled from a small number of simple parts.

Still another object of the invention is to provide a casing for use in single-stage or multi-stage in-line centrifugal pumps.

A further object of the invention is to provide a novel and improved method of making the above outlined casing.

Another object of the invention is to provide a novel and improved method of assembling the sections of the casing with a partition which divides the interior of the casing into a suction chamber and a pressure chamber.

An additional object of the invention is to provide a novel and improved method of transmitting forces from the inlet to the outlet of the above outlined casing.

SUMMARY OF THE INVENTION

The invention is embodied in a centrifugal pump, and more particularly in an in-line pump casing which comprises two shell-shaped sections disposed at opposite sides of a predetermined plane and jointly defining a suction intake and an outlet which is remote from the intake, and a partition which is disposed between the two sections in the predetermined plane and includes an inlet shroud in the region of the inlet and an outlet shroud in the region of the outlet. The inlet shroud is disposed at least in part at one side and the outlet shroud is disposed at least in part at the other side of the predetermined plane. The partition defines a suction chamber with one of the sections and a pressure chamber with the other section.

An opening in the partition establishes communication between the suction chamber and the pressure chamber. The axis of the pump shaft is normal to the predetermined plane, and the two sections are preferably mirror images of each other with reference to such plane. The latter preferably halves the inlet and the outlet.

The other section is provided with a centrally located aperture.

The inlet shroud can be adjacent or can actually extend into the suction inlet, and the outlet shroud can be adjacent and can actually extend into the outlet.

A portion of a housing (e.g., the housing of a first pump stage or the housing of the only pump stage) can extend into the opening of the partition. Such housing can extend from the casing by way of the aperture in the other section. Alternatively, a portion of the impeller of the pump in the region of the opening in the partition can define with the latter a throttling gap which forms part of the opening.

The sections can be provided with outwardly extending flanges at opposite sides of the predetermined plane, and the partition then includes marginal portions which are disposed between and are sealingly connected (e.g., soldered, glued or welded) to the flanges.

The casing can have a polygonal outline between the inlet and the outlet, and the inlet as well as the outlet can have a substantially circular outline.

The novel features which are considered as characteristic of the invention are set forth in particular in the appended claims The improved pump itself, however, both as to its construction and the mode of assembling its casing, together with additional features and advantages thereof, will be best understood upon perusal of the following detailed description of certain presently preferred specific embodiments with reference to the accompanying drawing.

DESCRIPTION OF PREFERRED EMBODIMENTS

Figure 1:
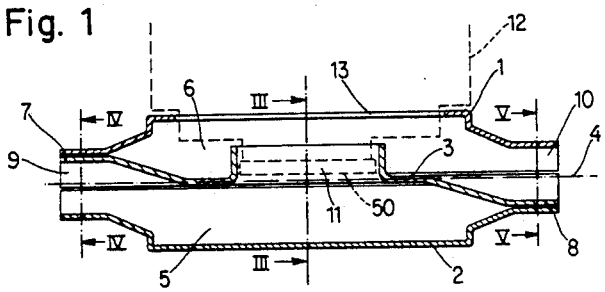
FIG. 1 is a longitudinal sectional view of an in-line pump casing which embodies the invention.
Figure 3:
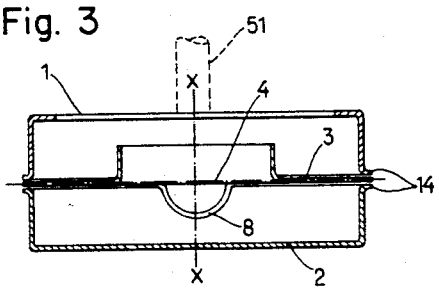
FIG. 3 is a transverse sectional view substantially as seen in the direction of arrows from the line III—III of FIG. 1.

The casing which is shown in the drawing comprises two shell-shaped sections 1 and 2 which are mirror images of each other with reference to a plane 4 where they confine a partition 3. The sections 1 and 2 have outwardly extending flanges 14 which are disposed at opposite sides of the plane 4 and are welded, soldered, glued or otherwise sealingly secured to the respective marginal portions of the partition 3. The sections 1 and 2 can be made with one and the same tool; the only difference between these sections is that the section 1 is provided with a centrally located aperture 13 in register with a smaller centrally located opening 11 of the partition 3. The section 1 and the partition 3 define a pressure chamber or plenum chamber 6, and the section 2 and the partition 3 define a suction chamber 5. In the absence of an obstruction in the opening 11, the latter establishes communication between the chambers 5 and 6.

The sections 1, 2 jointly define a suction inlet 9 at one end and an outlet 10 at the other end of the casing. The plane 4 halves the inlet 9 and the outlet 10. The partition 3 includes an inlet shroud 7 which is adjacent and (as shown) can be partly or fully received in the inlet 9, and an outlet shroud 8 which is adjacent and (as shown) can be partially or fully received in the outlet 10. It will be noted that the shrouds 7, 8 are spaced apart from each other as seen in the direction from the inlet 9 toward the outlet 10, and these shrouds are disposed (at least in part) at opposite sides of the plane 4 with the opening 11 between them. The inlet 9 communicates with the suction chamber 5 and the outlet 10 communicates with the pressure chamber 6.

The reference character 12 denotes a portion of a housing forming part of the first or only stage of the pump. An impeller 50 (indicated by broken lines) defines with the partition a throttling gap between the chambers 5 and 6. Reference may be had to U.S. Pat. No. 3,059,582 to Greene et al. The axis X-X of the pump shaft 51 (indicated by broken lines) is normal to the plane 4. The housing 12 or the impeller extends from the casing by way of the aperture 13 in the section 1. The aperture 13 can be formed in the section 1 in a stamping or like machine in which the section 1 is made, i.e., the making of such aperture does not necessitate treatment of the section 1 in a separate machine.

If the marginal portions of the partition 3 are welded to the flanges 14 of the sections 1 and 2, the material of such marginal portions and flanges can serve as the material of the welded seams.

Figure 4:
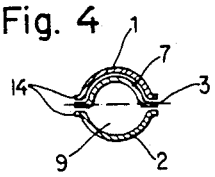
FIG. 4 is a transverse sectional view substantially as seen in the direction of arrows from the line IV—IV of FIG. 1.
Figure 2:
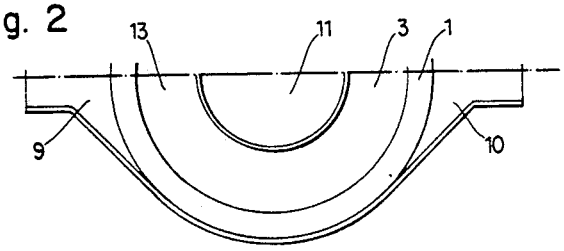
FIG. 2 is a fragmentary plan view of the casing.
Figure 5:
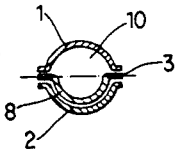
FIG. 5 is a transverse sectional view substantially as seen in the direction of arrows from the line V—V of FIG. 1.

FIG. 4 shows that the configuration of the inlet shroud 7 conforms to the configuration of one-half of the inlet 9, and FIG. 5 shows that the configuration of the outlet shroud 8 conforms to that of one-half of the outlet 10. This not only contributes to a streamlining of the path for the flow of fluids into and from the casing but also contributes to stability of the casing and of its parts. FIGS. 4 and 5 further show that the shrouds 7 and 8 are disposed at opposite sides of the plane 4. The configuration of the shroud 7 is such that this shroud does not interfere with the flow of a fluid from the inlet 9 into the suction chamber 5, and the configuration of the shroud 8 is such that this shroud does not interfere with the flow of a fluid from the pressure chamber 6 into the outlet 10.

The aforementioned welded seam or another suitable bond between the flanges 14 of the sections 1, 2 and the marginal portions of the partition 3 can constitute the only means for sealingly securing these parts to each other and for sealing the chambers 5, 6 from one another (save for the opening 11 in the partition 3).

An important advantage of the improved casing is that the partition 3 establishes a path for direct transmission of forces between the inlet 9 and the outlet 10. This partition greatly reduces the likelihood of distortion of the casing under the action of forces which are applied by the pipe connecting the inlet 9 with a source of fluid and/or by the pipe connecting the outlet 10 with a consumer of pressurized fluid. Additional strengthening of the casing is achieved as a result of the provision of shrouds 7 and 8 which extend into and follow the outlines of the inlet 9 and outlet 10 in a manner as shown in FIGS. 4 and 5.

Another important advantage of the improved casing is its simplicity which entails a reduction of the manufacturing cost. The three parts (1, 2 and 3) of the casing can be properly positioned relative to each other in a simple, inexpensive and time-saving manner in order to enable an available welding or other bonding machine to sealingly secure the marginal portions of the partition 3 to the flanges 14 of the sections 1 and 2 and to thus complete the making of the casing. The partition 3 is a simple component which can be made in a single operation in an available stamping or other suitable machine. The bonding operation is carried out in a single plane which renders it possible to resort to an automatic welding or other machine and to complete the bonding operation within a short interval of time. The shrouds 7 and 8 offer minimal resistance to the flow of a fluid from the inlet 9 into the suction chamber 5 and from the pressure chamber 6 into the outlet 10. In addition, these shrouds serve as a means for transmitting forces from the inlet 9 to the median portion of the partition 3 and from such median portion of the partition to the outlet 10. Still further, the shrouds 7 and 8 contribute to stability and rigidity of the partition 3 and of the entire casing, not only because of their configuration but also because they extend into the inlet 9 and outlet 10 of the casing as well as because they are disposed at opposite sides of the plane 4.

The configuration of the shroud 7 can be such that it is in full surface-to-surface contact with the adjacent portion of the inlet 9 to thus ensure that the inlet 9 is sealed from the pressure chamber 6. Analogously, the shroud 8 can cooperate with the adjacent portion of the outlet 10 to ensure that the suction chamber 5 is reliably sealed from the outlet. The reliability of sealing engagement between the shroud 7 and the inlet 9 on the one hand and between the shroud 8 and the outlet 10 on the other hand depends upon the intended use of the improved casing.

The partition 3 can be made from a metallic blank, e.g., in a deep drawing machine. Such procedure renders it possible to provide the partition with the shrouds 7 and 8 in a single operation. The provision of shrouds 7 and 8 at opposite ends of the partition 3 (as seen in the direction from the inlet 9 toward the outlet 10) simplifies the making of the partition and enhances its stability. Such stability is enhanced still further as a result of welding, soldering, bonding or otherwise reliably securing the marginal portions of the partition 3 to the flanges 14 of the sections 1 and 2.

The manner in which the inlet 9 can be connected with a first pipe and in which the outlet 10 can be connected with a second pipe forms no part of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. In a centrifugal pump, an in-line pump casing comprising first and second substantially shell-shaped sections disposed at opposite sides of a predetermined plane and jointly defining a suction inlet and an outlet remote from said inlet, inlet and said outlet each having first and second portions each formed as a unit with the respective section; and a partition disposed between said sections in said plane and including an inlet shroud disposed in the region of said inlet at least in part at one side of said plane and an outlet shroud disposed in the region of said outlet at least in part at the other side of said plane, said partition defining a suction chamber with one of said sections and a pressure chamber with the other of said sections.

2. The structure of claim 1, wherein said partition has an opening which establishes communication between said chambers.

3. The structure of claim 2, further comprising a pump shaft having an axis disposed at right angles to said plane.

4. The structure of claim 2, wherein said plane halves said inlet and said outlet.

5. The structure of claim 2, wherein said other section has a centrally located aperture.

6. The structure of claim 2, wherein said inlet shroud is adjacent said inlet and said outlet shroud is adjacent said outlet.

7. The structure of claim 2, wherein said inlet shroud extends into said inlet and said outlet shroud extends into said outlet.

8. The structure of claim 2, wherein said shrouds are spaced apart from each other in a direction from said inlet toward said outlet.

9. The structure of claim 2, further comprising a housing having a portion sealingly received in said opening.

10. The structure of claim 9, wherein said other section has an aperture and said housing extends from the casing by way of said aperture.

11. The structure of claim 2, further comprising an impeller having a portion disposed in the region of said opening and defining with said partition a throttling gap forming part of said opening.

12. The structure of claim 1, wherein said sections have outwardly extending flanges at opposite sides of said plane and said partition has marginal portions disposed between and sealingly connected with said flanges.

13. The structure of claim 1, wherein said casing includes a portion disposed between said inlet and said outlet and having a polygonal cross-sectional outline, said inlet and said outlet having substantially circular cross-section outlines.

* * * * *